United States Patent [19]

Gustavsson

[11] 4,197,267

[45] Apr. 8, 1980

[54] METHOD FOR FORMING A WEB OF MATERIAL

[75] Inventor: Lennart Gustavsson, Växjö, Sweden

[73] Assignee: Aktiebolaget Svenska Flaktfabriken, Nacka, Sweden

[21] Appl. No.: 884,850

[22] Filed: Mar. 9, 1978

Related U.S. Application Data

[63] Continuation-in-part of Ser. No. 725,276, Sep. 21, 1976, Pat. No. 4,099,296.

[30] Foreign Application Priority Data

May 25, 1977 [SE] Sweden ..... 7703460

[51] Int. Cl.[2] ..... B29B 5/00

[52] U.S. Cl. ..... 264/24; 264/121

[58] Field of Search ..... 264/24, 121

[56] References Cited

U.S. PATENT DOCUMENTS

| | | | |
|---|---|---|---|
| 3,150,215 | 9/1964 | Houghton | 264/121 |
| 3,158,668 | 11/1964 | Johnson | 264/121 |
| 3,777,231 | 12/1973 | Guschin | 264/121 |
| 4,099,296 | 7/1978 | Gustavsson | 19/304 |

FOREIGN PATENT DOCUMENTS

| | | | |
|---|---|---|---|
| 190555 | 12/1966 | U.S.S.R. | 19/156.3 |

*Primary Examiner*—Robert F. White
*Assistant Examiner*—James R. Hall
*Attorney, Agent, or Firm*—Dann, Dorfman, Herrell and Skillman

[57] ABSTRACT

A web is formed from particulate material, for example, wood fibers, by depositing the fibers on a conveyor surface in a distribution chamber. The particulate material is introduced into the distribution chamber at its top by a carrier air stream which is caused to oscillate across the surface by impulses from separate control blow boxes on the opposite sides of the stream. The particulate material is thoroughly dispersed in the air stream by passage through a transition zone where the carrier air stream is deflected into a zigzag path and its flow velocity is reduced. The effect of static electricity on the particles in the carrier stream is reduced by lining the transition zone with nonconductive material and providing ionizing devices in the blow boxes for the air flow passing through the control boxes, or in the chamber adjacent the boxes.

10 Claims, 6 Drawing Figures

METHOD FOR FORMING A WEB OF MATERIAL

This application is a continuation-in-part of U.S. application, Ser. No. 725,276, filed Sept. 21, 1976, now U.S. Pat. No. 4,099,296.

The present invention relates to a method for forming a web and constitutes an improvement on the method disclosed in my U.S. Pat. No. 4,099,296.

As shown in my prior patent, a web is formed on a conveyor by carrying particulate material into a distribution chamber by means of a carrier air stream. The air stream is oscillated across the width of the chamber by impulses from control jets to form a web on the conveyor surface which has proved very efficient with a good yield with respect to uniformity and quality in general. In certain installations, however, problems have arisen when the composite stream of materials supplied to the distribution chamber is discharged with sufficient speed to form streaks, resulting in irregularities in the web formed. Furthermore, static electricity generated by wood particles, in particular particles which have a moisture content of below 10%, causes irregularities in the forming process since the charged particles may deposit on the walls of the chamber and are dropped randomly in clumps. Under severe conditions the electrostatic charge may be sufficient to cause sparking. The present invention provides a method for eliminating these problems and thereby enhances the uniformity and quality of the web material formed, regardless of the problems caused by the materials discussed above.

Specifically, the present invention provides a transition zone for the composite flow of carrier air and the particulate material in advance of its entry into the distribution chamber to assure uniform dispersion of the particulate material throughout the carrier air stream, and the invention also reduces the static electricity on the particles in the distribution chamber.

All of the objects of the invention are more fully set forth hereinafter with reference to the accompanying drawings, wherein.

Figure 5:
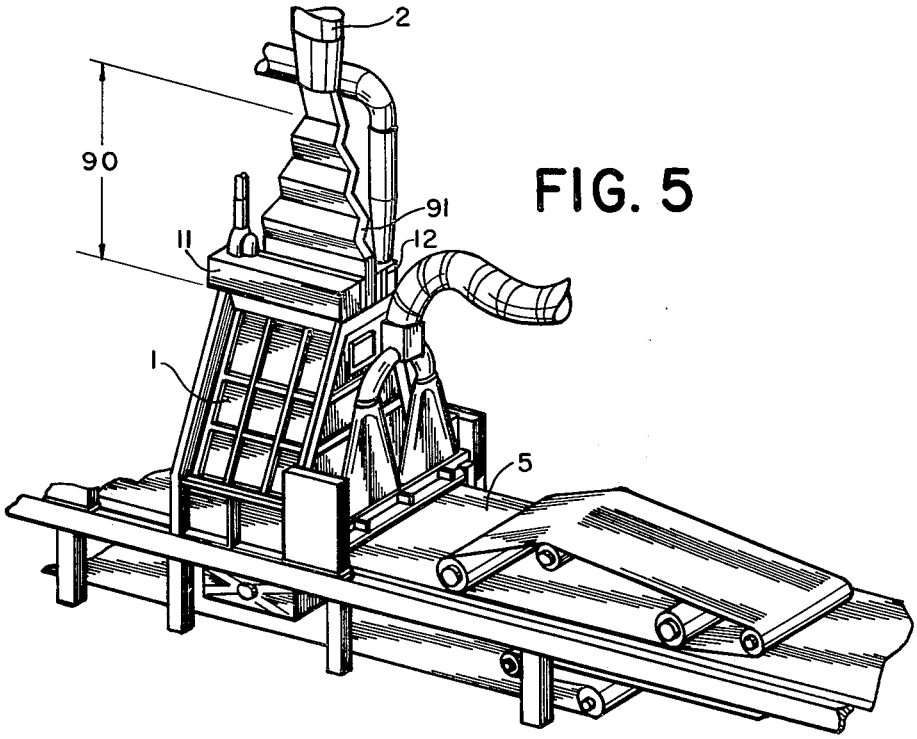
FIG. 5 is a perspective view of web-forming apparatus for practicing the present invention.
Figure 6:
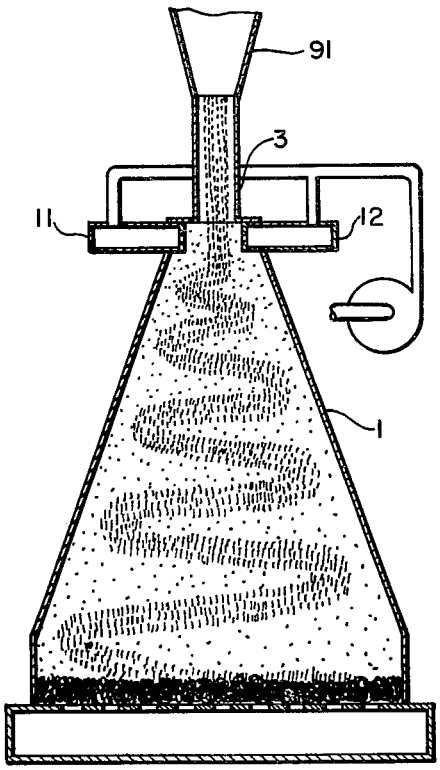
FIG. 6 is a transverse section through the distribution chamber.

With reference to FIG. 5, the illustrated apparatus for practicing the present invention provides a distribution chamber 1 which is open at its bottom to accomodate a running conveyor belt 5 which forms the deposition surface of the web forming apparatus. At the top of the chamber 1, blow boxes 11 and 12 are provided on opposite sides of an inlet nozzle 3 (see FIG. 6) which is connected to a supply conduit 2 through a transition zone 90 having a zigzag-shaped passageway 91. As indicated in FIG. 6, the composite flow from the passageway 91 is introduced into chamber 1 through the nozzle 3 and is caused to oscillate across the width of the chamber by means of impulse jets issuing from apertures in the confronting walls of the blow boxes 11 and 12, as described in detail in the prior patent.

Figure 1:
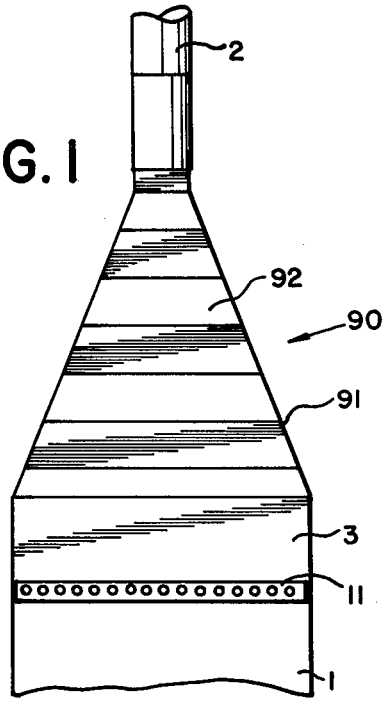
FIG. 1 is a longitudinal section through a transition zone of the web forming apparatus.
Figure 2:
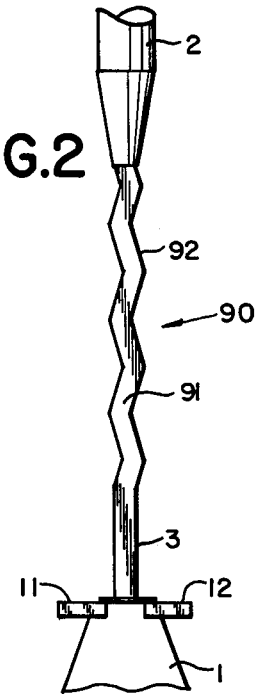
FIG. 2 is a side elevation of the transition zone.

In accordance with the present invention, the transition zone 90 provides a thorough dispersion of the particulate material throughout the carrier air flow. To this end, the cross section of the transition zone diverges in the direction of the fiber flow and the longitudinal direction of the web being formed. As further appears from FIGS. 2 and 5, the transition zone 90 provides a zigzag passageway which thereby deflects the carrier air stream and with the particles therein several times throughout its passage through the transition zone 90. Each deflection of the composite flow generates a resistance which is balanced with the change in dynamic pressure resulting from the reduction of air velocity caused by the expanding cross section of the passageway. The combination of the reducing air speed and the deflecting walls of the passageway assures against limited zones of excess speed which might cause streaks. Thus, the composite gas/particle stream has a uniform speed profile as it leaves the nozzle 3 and flows into the distribution chamber 1. During the passage of the composite flow through the transition zone, the velocity of the flow is reduced, for example, from 25 meters per second to 10 meters per second. Preferably the velocity of the composite flow is reduced to at least one half its initial velocity.

In accordance with another feature of the invention, the transition passageway 91 is lined with wood material 92, preferably plywood, wood fiberboard, or the like, whereby an efficient reduction of the static electricity of the particles or fibers is obtained. As an example, it may be mentioned that tests have proved that the use of this device results in a reduction in electric field strength from to 200,000 V/m to about 30,000 V/m. The invention is not limited to this particular configuration of transition zone, but other forms are possible. For example, the transition zone may be located remote from the distribution chamber in the distribution conduit 2.

Figure 3:
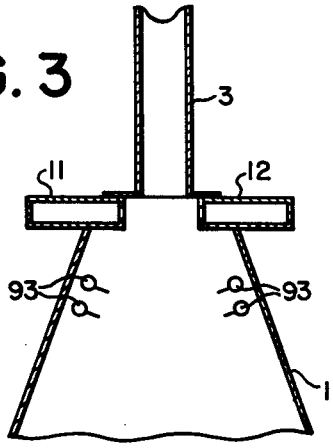
FIG. 3 illustrates the positioning of ionizing rods disposed in the distribution chamber.
Figure 4:
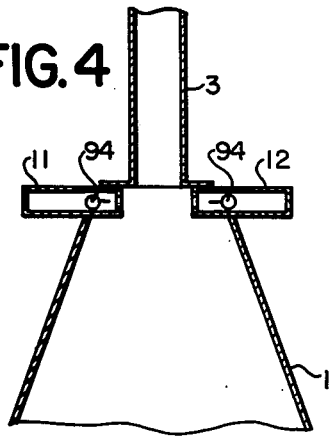
FIG. 4 illustrates ionizing rods mounted in the blow boxes.

In FIGS. 3 and 4, embodiments of blow boxes 11 and 12 are shown in detail. As shown in FIG. 3, ionizing rods 93 are disposed in the distribution chamber adjacent the blow boxes in order to further reduce static electricity. The ionizing rods are connected to an alternating-current source (not shown) to provide an electric voltage which ionizes the ambient gas and thereby reduces any static electricity remaining with the fibers of the composite flow issuing from the nozzle 3. Preferably the applied voltage is in an alternating-current voltage in the range of 3–20 kv. In FIG. 4, ionizing rods 94 are disposed within the blow boxes 11 and 12 for ionizing the flow which generates the impulse jets issuing from the apertures in the confronting walls of the blow boxes 11 and 12 for controlling the oscillation of the composite flow through the distribution chamber 1. By this arrangement, the impulse jets are ionized and are efficiently mixed into the composite stream. The ionizing rods, being disposed in the blow box, are protected against mechanical damage and are also protected against dust loading. Furthermore, the shielding of the rods within the blow box insures against contact with the personnel servicing installation.

While particular embodiments of the present invention have been herein illustrated and described, it it apparent that the invention is not limited to the particular embodiments illustrated but the features may be combined and modified, all within the scope of the following claims.

I claim:

1. In a method of forming a material web comprising the steps of causing a composite flow of particulate material in a gaseous carrier to flow into a distribution chamber, depositing particulate material from said flow on a carrier surface in the chamber to form a web of the particulate material on said surface, exposing the composite material flow in said distribution chamber to control flows of gaseous medium directed from opposite sides of the composite flow to cause the composite flow to oscillate across the width of the carrier surface and to distribute the particulate material across the same, the improvement comprising the additional steps of passing the composite flow of particulate material in the gaseous carrier through a transition zone prior to exposing the flow to control flows in said distribution chamber, and deflecting the composite flow several times throughout its passage through said transition zone whereby the particulate material is dispersed uniformly throughout the gaseous carrier.

2. A method according to claim 1 wherein the transition zone subjects the composite flow to zigzag deflection movements and to an expanding cross sectional passage area in the direction of the travel of the flow toward the carrier surface.

3. A method according to claim 2 wherein the expanded flow area in said transition zone reduces the velocity of the carrier flow to at least one half its initial velocity prior to its flow into said distribution chamber.

4. A method according to claim 1 wherein said particulate material generates static electricity therein, and including the step of passing the composite flow in the transition zone between static-reducing material for reducing the static electricity of the particulate material.

5. A method according to claim 4 wherein said static-reducing material is composed of wood.

6. A method according to claim 1 wherein said particulate material generates static electricity therein, and including the step of reducing the static electricity of the particulate material by exposing the particulate material to ionized gas.

7. In a method of forming a material web comprising the steps of:

causing a composite flow of particulate material which generates static electricity therein, and a gaseous carrier medium to flow into a distribution chamber and causing the particulate material to be deposited on a deposition surface therein to form a web of said particulate material, exposing the composite material flow to control flows of gaseous control medium directed from opposite sides of the composite flow against the same, and alternating the control flows to distribute the composite flow across the width of the deposition surface, the improvement including the steps of reducing the static electricity of the particulate material in said composite flow by exposing the particulate material in the distribution chamber to ionized gas, and supplying the ionized gas to said chamber by ionizing the gaseous control medium in the control flows prior to directing them against the composite flow in the chamber.

8. A method according to claim 7 including the step of ionizing the control medium by ionizing rods.

9. In a method of forming a material web comprising the steps of:

causing a composite flow of particulate material which generates static electricity therein and a gaseous carrier medium to flow into a distribution chamber and causing the particulate material to be deposited on a deposition surface therein to form a web of said particulate material, exposing the composite material flow to control flows of gaseous control medium directed from opposite sides of the composite flow against the same, and alternating the control flows to distribute the composite flow across the width of the deposition surface, the improvement including the steps of reducing the static electricity of the particulate material in said composite flow by exposing the particulate material in the distribution chamber to ionized gas, and producing the ionized gas in the distribution chamber by ionizing the composite flow within said chamber after exposure to said control flows while it flows toward the deposition surface.

10. A method according to claim 7 or claim 9 including the step of producing the ionized gas by ionizing rods supplied with an electric alternating-current voltage between 3 and 20 kv.

* * * * *